US009651036B2

(12) United States Patent
Yamashita et al.

(10) Patent No.: US 9,651,036 B2
(45) Date of Patent: May 16, 2017

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Hideharu Yamashita, Kariya (JP); Shinya Yamamoto, Kariya (JP); Masaki Ota, Kariya (JP); Takahiro Suzuki, Kariya (JP); Hiroyuki Nakaima, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 248 days.

(21) Appl. No.: 14/665,449

(22) Filed: Mar. 23, 2015

(65) Prior Publication Data

US 2015/0275872 A1 Oct. 1, 2015

(30) Foreign Application Priority Data

Mar. 27, 2014 (JP) ..... 2014-065055

(51) Int. Cl.
*F04B 27/18* (2006.01)
*F04B 27/08* (2006.01)
(Continued)

(52) U.S. Cl.
CPC ..... *F04B 27/18* (2013.01); *F04B 27/0878* (2013.01); *F04B 27/109* (2013.01);
(Continued)

(58) Field of Classification Search
CPC ..... F04B 27/1804; F04B 2027/1809; F04B 2027/1813; F04B 2027/1818;
(Continued)

(56) References Cited

U.S. PATENT DOCUMENTS 4,174,191 A * 11/1979 Roberts ..... F04B 27/18 417/222.1
4,886,423 A * 12/1989 Iwanami ..... F04B 27/18 417/222.2

(Continued)

FOREIGN PATENT DOCUMENTS

JP 2004-218610 8/2004

*Primary Examiner* — Patrick Hamo
(74) *Attorney, Agent, or Firm* — Greenblum & Bernstein, P.L.C.

(57) ABSTRACT

A swash plate type variable displacement compressor includes a housing having a suction chamber, a discharge chamber, a swash plate chamber in communication with the suction chamber, a first cylinder block having a plurality of first cylinder bores and a second cylinder block having a plurality of second cylinder bores. The first cylinder bores and the second cylinder bores cooperate to form plural pairs of the first and second cylinder bores. The first cylinder block and the second cylinder block have on outer peripheral side thereof a first projection and a second projection projecting radially, respectively. The first projection and the second projection cooperate together to form an oil separation chamber, an oil reserve chamber, an intermediate pressure chamber and a gas release passage that provides fluid communication between the oil reserve chamber and the intermediate pressure chamber.

3 Claims, 7 Drawing Sheets

(51) Int. Cl.
*F04B 27/10* (2006.01)
*F04B 27/12* (2006.01)
*F04B 39/12* (2006.01)

(52) U.S. Cl.
CPC ..... *F04B 27/12* (2013.01); *F04B 27/1804* (2013.01); *F04B 39/121* (2013.01); *F04B 2027/1813* (2013.01); *F04B 2027/1827* (2013.01)

(58) Field of Classification Search
CPC ..... F04B 2027/1827; F04B 2027/1831; F04B 2027/1836
USPC ..... 417/222.1, 222.2
See application file for complete search history.

(56) References Cited

U.S. PATENT DOCUMENTS

| | | | | | |
|---|---|---|---|---|---|
| 5,370,503 | A * | 12/1994 | Terauchi | F04B 27/1072 | 417/222.2 |
| 5,882,180 | A * | 3/1999 | Kawaguchi | F04B 27/1804 | 417/222.2 |
| 6,217,293 | B1 * | 4/2001 | Murase | F04B 27/1804 | 417/222.2 |
| 2012/0073430 | A1 * | 3/2012 | Uchikado | F04B 27/1054 | 91/183 |

* cited by examiner

SWASH PLATE TYPE VARIABLE DISPLACEMENT COMPRESSOR

BACKGROUND OF THE INVENTION

The present invention relates to a swash plate type variable displacement compressor.

A swash plate type variable displacement compressor is disclosed in Japanese Patent Application Publication No. 2004-218610. The compressor includes a rear housing that has therein an oil separation chamber extending in radial direction of the rear housing and an oil reserve chamber formed below the oil separation chamber in the rear end of the compressor. A hole is formed between the oil separation chamber and the oil reserve chamber, providing a fluid communication therebetween. In addition, an inlet passage is formed in the rear housing through which the oil separation chamber communicates with a discharge chamber. A discharge hole is formed in the rear housing adjacent to the oil separation chamber on the downstream side and a check valve unit, which prevents backflow of the refrigerant gas in a discharge passage, is mounted on the discharge hole. The check valve unit is provided with a pipe projecting toward the oil separation chamber, and the check valve and the pipe cooperate to form an oil separating means. A gas return passage is formed as a passage that communicates an annular port (or an intermediate pressure chamber) in a base plate of the check valve unit with the oil reserve chamber. The diameter of the gas return passage is smaller (or approximately 1 mm) than the hole between the oil separation chamber and the oil reserve chamber, and the gas return passage functions so as to allow the refrigerant in the oil reserve chamber to return to the annular port formed in the discharge passage.

In this compressor, the compressed refrigerant gas discharged from the discharged chamber is introduced into the oil separation chamber through the inlet passage. The refrigerant gas thus flowed into the oil separation chamber impinges against the outer peripheral surface of the pipe and is then flowed toward the end of the pipe while swirling around the pipe along the outer peripheral surface thereof, with the result that the oil contained in the refrigerant gas in mist form is separated from the refrigerant gas. The oil thus separated from the refrigerant gas is accumulated in the bottom of the oil separation chamber and is then flowed into the oil reserve chamber through the through hole. The oil in the oil reserve chamber is returned to a crank chamber. The refrigerant gas having the oil separated therefrom is flowed through the pipe and is then discharged to the external refrigerant circuit via a discharge pipe. Because the gas return passage is formed between the discharge passage of the refrigerant gas and the oil reserve chamber, the differential pressure $\Delta P$ between the oil separation chamber and the discharge passage causes the refrigerant gas to flow, and the oil separated from the refrigerant gas in the oil separation chamber is entrained by the refrigerant gas and flowed immediately into the oil reserve chamber through the hole.

In the compressor of the above-cited publication, however, a hole having a small diameter (approximately 1 mm) needs to be formed in the rear housing as a gas return passage that provides fluid communication between the annular port in the check valve unit and the oil reserve chamber. Machining the gas return passage of a small diameter with a drill or an end mill is extremely difficult.

The present invention, which has been made in light of the above-identified problems, is directed to providing a swash plate type variable displacement compressor that permits easy machining of a gas return passage providing fluid communication between an annular port and an oil reserve chamber.

SUMMARY OF THE INVENTION

In accordance with an aspect of the present invention, there is provided a swash plate type variable displacement compressor including a housing having a suction chamber, a discharge chamber, a swash plate chamber in communication with the suction chamber, a first cylinder block having a plurality of first cylinder bores and a second cylinder block having a plurality of second cylinder bores. The first cylinder bores and the second cylinder bores cooperate to form plural pairs of the first and second cylinder bores. The swash plate type variable displacement compressor further includes a drive shaft rotatably supported in the housing, a swash plate rotatable in the swash plate chamber by the rotation of the drive shaft, a link mechanism provided between the drive shaft and the swash plate to change an inclination angle of the swash plate. A plurality of double head pistons is provided reciprocally movable in the respective pairs of the first and second cylinder block bores. The swash plate type variable displacement compressor further includes a conversion mechanism converting the rotation of the swash plate to the reciprocal motion of the double head pistons with a stroke length that is variable according to the inclination angle of the swash plate, an actuator disposed in the swash plate chamber to change the inclination angle of the swash plate and a control mechanism controlling the actuator. The actuator includes a partitioning member provided on the drive shaft, a moving member that is connected to the swash plate and movable in an axial direction of the drive shaft in the swash plate chamber and a pressure control chamber that is defined by the partitioning member, the moving member and the drive shaft. The moving member is movable by pressure in the pressure control chamber. The first cylinder block and the second cylinder block have on outer peripheral side thereof a first projection and a second projection projecting radially, respectively. The first projection and the second projection cooperate together to form at least two chambers in one of which a check valve unit including an oil separator and a check valve is disposed. One of the chambers is an oil separation chamber in which the oil separator is disposed to separate oil contained in refrigerant gas being discharged from the discharge chamber. The check valve is disposed downstream of the oil separator. The other chamber is in communication with the oil separation chamber and reserves the oil being separated from the refrigerant gas in the oil separation chamber. An intermediate pressure chamber is formed between the oil separator and the check valve and has pressure lower than the oil separation chamber. The first cylinder block and the second cylinder block are joined via a gasket. A gas release passage is formed between the first projection or the second projection and the gasket to provide fluid communication between the oil reserve chamber and the intermediate pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
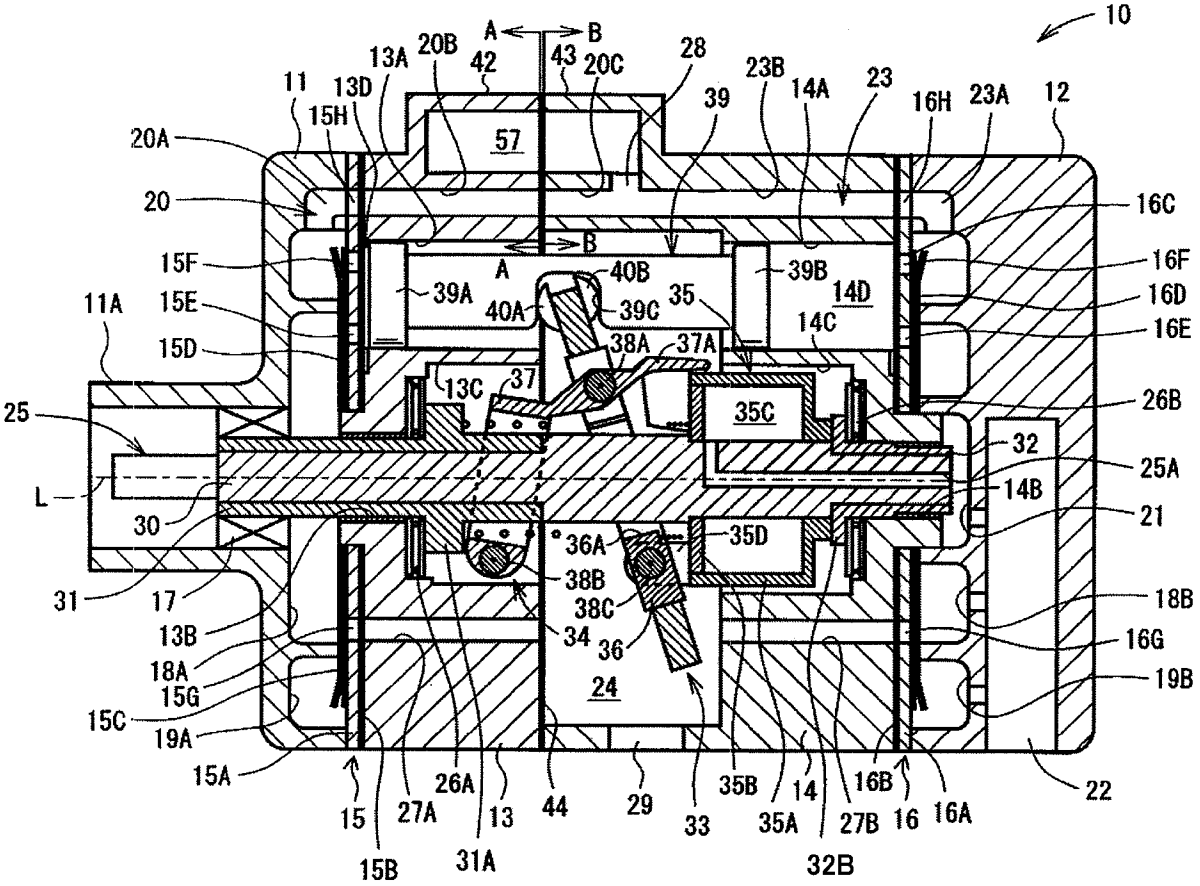
FIG. 1 is a longitudinal cross-section view showing the overall structure of a swash plate type variable displacement compressor according to an embodiment of the invention.

The following will describe a compressor according to an embodiment of the present invention with reference to FIGS. 1 to 6. The compressor shown in FIG. 1 and designated by numeral 10 is a swash plate type variable displacement compressor. The swash plate type variable displacement compressor 10 (hereinafter referred to as the compressor) employs a double head piston. As shown in FIG. 1, the compressor 10 includes a front housing 11, a rear housing 12, and a first cylinder block 13 and a second cylinder block 14 which are disposed between the front housing 11 and the rear housing 12. The front housing 11 is connected to the first cylinder block 13 with a first valve forming plate 15 interposed therebetween. The rear housing 12 is connected to the second cylinder block 14 with a second valve forming plate 16 interposed therebetween. Furthermore, the first cylinder block 13 and the second cylinder block 14 are joined via a gasket 44 interposed therebetween. The front housing 11, the rear housing 12, the first cylinder block 13 and the second cylinder block 14 are fastened together by a bolt (not shown).

The front housing 11 is formed with a boss 11A projecting forward and having therein a shaft seal device 17. A first suction chamber 18A and a first discharge chamber 19A are formed in the front housing 11. The first suction chamber 18A, is positioned in the radial center of the front housing 11 and the first discharge chamber 19A is positioned radially outward of the first suction chamber 18A. The front housing 11 has therein a first front communication passage 20A which is in communication at the front end thereof with the first discharge chamber 19A and the rear end is opened through the rear end of the front housing 11.

The rear housing 12 has therein a second suction chamber 18B, a second discharge chamber 19B and a pressure adjusting chamber 21. The pressure adjusting chamber 21 is positioned in the center of the rear housing 12. The second suction chamber 18B is positioned radially outward of the pressure adjusting chamber 21 in the rear housing 12. The second discharge chamber 19B is positioned radially outward of the second suction chamber 18B. The rear housing 12 further has therein a control mechanism 22 that controls an actuator 35, which will be described later. The rear housing has therein a first rear communication passage 23A which is in communication at the rear end thereof with the second discharge chamber 19B and front end is opened through the front end of the rear housing 12.

A swash plate chamber 24 is formed between the first cylinder block 13 and the second cylinder block 14. The swash plate chamber 24 is disposed substantially in the center of the housing in the longitudinal direction of the compressor 10. The first cylinder block 13 has therein a plurality of first cylinder bores 13A which are formed parallel to each other and spaced angularly at a regular interval. A first shaft hole 13B is formed in the first cylinder block 13. The first shaft hole 13B is provided therein with a slide bearing and a drive shaft 25 is inserted the first shaft hole 13B. In addition, a first recess 130 is formed in the first cylinder block 13 in communication with the swash plate chamber 24. A first thrust bearing 26A is provided in the first recess 13C at the bottom thereof. The first cylinder block 13 has a first communication passage 27A formed therethrough that provides a fluid communication between the swash plate chamber 24 and the first suction chamber 18A. Furthermore, the first cylinder block 13 further has therein a second front communication passage 20B. The first cylinder block 13 has on outer peripheral side thereof a first projection 42 projecting radially. The first projection 42 will be described later.

Similarly to the first cylinder block 13, a plurality of second cylinder bores 14A is formed in the second cylinder block 14. Each second cylinder bore 14A has the same diameter as the first cylinder bore 13A and is disposed coaxially with its corresponding first cylinder bore 13A so as to be paired. The second cylinder block 14 has therein a second shaft hole 14B through which the drive shaft 25 is inserted. The second shaft hole 14B is provided with a slide bearing. A second recess 14C is formed in the second cylinder block 14 in communication with the swash plate chamber 24. The second recess 14C has a second thrust bearing 26B disposed at the bottom thereof. In addition, the second cylinder block 14 has therein a second communication passage 27B which provides a communication between the swash plate chamber 24 and the second suction chamber 18B. The second cylinder block 14 has on outer peripheral side thereof a second projection 43 projecting radially. The second projection 43 will be described later.

The second cylinder block 14 has formed therein a discharge port 28, a third rear communication passage 20C, a second rear communication passage 23B and a suction port 29. The discharge port 28 is in communication with a muffler chamber 57. The front end of the third rear communication passage 20C is opened at the front end of the second cylinder block 14 and the rear end of the third rear communication passage 20C is in communication with the discharge port 28. With the first cylinder block 13 and the second cylinder block 14 joined together, the third rear communication passage 20C is in communication with the second front communication passage 20B at the rear end thereof. The front end of the second rear communication passage 23B is in communication with the discharge port 28 and the rear end of the second rear communication passage is opened at the rear end of the second cylinder block 14. The suction port 29 is formed so as to provide fluid communication between the swash plate chamber 24 and the external refrigeration circuit (not shown) so that refrigerant gas is introduced from the external refrigeration circuit into the swash plate chamber 24 through the suction port 29.

The first valve forming plate 15 includes a first valve plate 15A, a first suction valve plate 15B, a first discharge valve plate 15C and a first retainer plate 15D. The first valve plate 15A, the first discharge valve plate 15C and the first retainer plate 15D have formed therethrough a first suction hole 15E that provides a communication between the first cylinder bore 13A and the first suction chamber 18A. The first valve plate 15A and the first suction valve plate 15B have formed therethrough a first discharge hole 15F that provides a communication between the first cylinder bore 13A and the first discharge chamber 19A. The first suction hole 15E has a first suction valve that opens and closes the first suction hole 15E. The first discharge hole 15F has a first discharge valve that opens and closes the first discharge hole 15F. The first valve forming plate 15 has formed therethrough a first suction communication hole 15G that provides a communication between the first suction chamber 18A and the first communication passage 27A and a first discharge communication hole 15H that provides a communication between the first front communication passage 20A and the second front communication passage 20B.

The second valve forming plate 16 includes a second valve plate 16A, a second suction valve plate 16B, a second discharge valve plate 16C and a second retainer plate 16D. The second valve plate 16A, the second discharge valve plate 16C and the second retainer plate 16D have formed therethrough a second suction hole 16E that provides a communication between the second cylinder bore 14A and the second suction chamber 18B. The second valve plate 16A and the second suction valve plate 16B have formed therethrough a second discharge hole 16F that provides a communication between the second cylinder bore 14A and the second discharge chamber 19B. The second suction hole 16E has a second suction valve that opens and closes the second suction hole 16E. The second discharge hole 16F has a second discharge valve that opens and closes the second discharge hole 16F. The second valve forming plate 16 has formed therethrough a second suction communication hole 16G that provides a communication between the second suction chamber 18B and the second communication passage 27B and a second discharge communication hole 16H that provides a communication between the first rear communication passages 23A and the second rear communication passage 23B.

In the compressor 10, the first front communication passage 20A, the first discharge communication hole 15H, the second front communication passage 20B and the third rear communication passage 20C cooperate to form a first discharge communication passage 20. The first rear communication passage 23A, the second discharge communication hole 16H and the second rear communication passage 23B cooperate to form a second discharge communication passage 23.

The drive shaft 25 includes a drive shaft body 30, a first support member 31 and a second support member 32. The first support member 31 is press-fitted on the front end of the drive shaft body 30 and the second support member 32 is press-fitted on the rear end thereof. The first support member 31 has a flange 31A. The second support member 32 has a flange 32A. The front end of the drive shaft 25 is inserted in the first shaft hole 13B of the first cylinder block 13 through the first support member 31 and the rear end thereof is inserted in the second shaft hole 14B of the second cylinder block 14 through the second support member 32, respectively, and the drive shaft 25 is rotatably supported in the housing by slide bearings.

A swash plate 33, a link mechanism 34 and the aforementioned actuator are mounted on the drive shaft body 30 in the swash plate chamber 24. The swash plate 33 is formed in an annular shape and fixed to a ring plate 36. The ring plate 36 is also formed in an annular shape having an insertion hole 36A at the center. With the drive shaft body 30 inserted through the insertion hole 36A of the ring plate 36 in the swash plate chamber 24, the swash plate 33 is engaged with the drive shaft 25.

The link mechanism 34 includes a lug arm 37. The lug arm 37 is disposed frontward of the swash plate 33 in the swash plate chamber 24, or positioned between the swash plate 33 and the first support member 31. The lug arm 37 is formed substantially in an L-shape. It is so configured that the lug arm 37 is brought into contact with the flange 31A of the first support member 31 when the inclination angle of the swash plate 33 relative to an imaginary plane extending perpendicularly to an axis L of the drive shaft becomes minimum. The lug arm 37 has at the rear end thereof a weight portion 37A.

The lug arm 37 is connected at the rear end thereof to one end of the ring plate 36 by a first pin 38A so as to be swingable about the first pin 38A relative to the swash plate 33. The lug arm 37 is also connected at the front end thereof to the first support member 31 by a second pin 38B so as to be swingable about the second pin 38B relative to the drive shaft 25. Thus, the link mechanism 34 is provided between the drive shaft 25 and the swash plate 33 and includes the first pin 38A and the second pin 38B, as well as the lug arm 37.

In the compressor 10, the connection of the swash plate 33 and the drive shaft 25 via the link mechanism 34 allows the swash plate 33 to rotate with the drive shaft 25. Furthermore, the swinging causes the swash plate 33 to change its inclination angle. In other words, the swash plate 33 is tiltable by the link mechanism 34 to change the inclination angle.

A double head piston 39 is received in each pair of the first and second cylinder bores 13A, 14A. The double head piston 39 has a first head portion 39A in the front end and a second head portion 39B at the rear end. The first head portion 39A is reciprocally received in the first cylinder bore 13A. A first compression chamber 13D is formed in the first cylinder bore 13A defined by the first head portion 39A and the first valve forming plate 15. The second head portion 39B is reciprocally received in the second cylinder bore 14A. A second compression chamber 14D is formed in the second cylinder bore 14A defined by the second head portion 39B and the second valve forming plate 16.

A piston recess 39C is formed in the center of the double head piston 39 and a pair of hemispherical shoes 40A, 40B is disposed in the piston recess 39C so as to hold therebetween the swash plate 33 so that the rotation of the swash plate 33 is converted to the reciprocal motion of the double head piston 39 through the pair of shoes 40A, 40B. The pair of shoes 40A, 40B corresponds to the conversion mechanism of the present invention. Therefore, the first head portion 39A and the second head portion 39B of the double head piston 39 are reciprocated in the first cylinder bore 13A and the second cylinder bore 14A, respectively, with a stroke length that is variable according to the inclination angle of the swash plate 33.

The actuator 35 includes a moving member 35A and a partitioning member 35B and a pressure control chamber 35C is formed between the moving member 35A and the partitioning member 35B. The actuator 35 is located rearward of the swash plate 33 and can be moved into the second recess 14C. The moving member 35A has a bottomed cylindrical shape and has an opening at the front thereof that is closed by the partitioning member 35B. The moving member 35A has a connecting member 35D extending frontward the front end of the peripheral wall thereof. The partitioning member 35B is formed in a disk shape having substantially the same diameter as the inner diameter of moving member 35A. A return spring is provided between the partitioning member 35B and the moving member 35A. The pressure control chamber 35C is defined by the partitioning member 35B, the moving member 35A and the drive shaft 25, and the moving member 35A is movable relative to the partitioning member 35B by the pressure in the pressure control chamber 35C.

The drive shaft body 30 is inserted through the moving member 35A and the partitioning member 35B. The moving member 35A is mounted on the drive shaft 25 so as to be rotatable therewith and also movable relative thereto in the axial direction L of the drive shaft 25 in the swash plate chamber 24. On the other hand, the partitioning member 35B is provided on the drive shaft body 30 of the drive shaft 25 for rotation therewith.

The connecting member 35D of the moving member 35A is connected to the other end of the ring plate 36 by a third pin 38C, so that the swash plate 33 is supported by the moving member 35A and swingable about the axis of the third pin 38C. Thus, the moving member 35A is connected to the swash plate 33. The moving member 35A is brought into contact with the flange 32A of the second support member 32 when the inclination angle of the swash plate 33 becomes maximum. FIG. 1 shows the state that the inclination angle of the swash plate 33 is at maximum. An in-shaft passage 25A is formed in the drive shaft body 30. As shown in FIG. 1, the front end of the in-shaft passage 25A is opened through the outer peripheral surface of the drive shaft body 30 to the pressure control chamber 35C and the rear end of the in-shaft passage 25A is opened through the rear end thereof to the pressure adjusting chamber 21.

The control mechanism 22 includes a low pressure passage, a high pressure passage, a control valve and an orifice (none of these being shown). The pressure adjusting chamber 21 is in communication with the second suction chamber 18B through the low pressure passage and the control valve of the control mechanism 22. The pressure adjusting chamber 21 is in communication with the second discharge chamber 19B through the high pressure passage and the orifice. In addition, the pressure adjusting chamber 21 is in communication with the pressure control chamber 35C through the in-shaft passage 25A In the control mechanism 22, the pressure in the pressure adjusting chamber 21 and the pressure in the pressure control chamber 35C become substantially the same as the internal pressure of the second suction chamber 18B when the opening of the low pressure passage is increased by the control valve. Accordingly, the moving member 35A of the actuator 35 is moved frontward in the swash plate chamber 24. As the moving member 35A is moved toward the lug arm 37, the volume of the pressure control chamber 35C is decreased, and consequently the swash plate 33 swings in clockwise direction about the axis of the third pin 38C, as viewed in FIG. 1. In addition, the lug arm 37 swings in clockwise direction about the first pin 38A and in counterclockwise direction about the second pin 38B, as viewed in FIG. 1. The lug arm 37 is moved closer to the flange 31A of the first support member 31. As a result, the inclination angle of the swash plate 33 relative to an imaginary plane extending perpendicularly to the axis L of the drive shaft 25 is deceased and the stroke length of the double head piston 39 is decreased, accordingly, thus decreasing the displacement of the compressor 10.

When the opening of the low pressure passage is decreased by the control valve of the control mechanism 22, on the other hand, the pressure in the pressure adjusting chamber 21 is increased and the pressure in the pressure control chamber 35C is increased, accordingly. In the actuator 35, the moving member 35A is moved rearward in the swash plate chamber 24. Consequently, the moving member 35A is moved away from the lug arm 37 and, therefore, the volume of the pressure control chamber 35C is increased. The moving member 35A pulls the lower end of the swash plate 33 rearward through the connecting member 35D. Consequently, the swash plate 33 swings in counterclockwise direction about the third pin 38C and the second pin 38B, as viewed in FIG. 1. The lug arm 37 is moved away from the flange 31A of the first support member 31. As a result, the inclination angle of the swash plate 33 is increased and, therefore, the stroke length of the double head piston 39 is decreased, with the result that the displacement of the compressor 10 is increased.

In the compressor 10, the rotation of the swash plate 33 by the drive shaft 25 causes the double head piston 39 to reciprocate in the paired first and second cylinder bores 13A, 14A. The volume of the first compression chamber 13D and the second compression chamber 14D is changed with the movement of the double head piston 39. In the compressor 10, the suction stroke in which refrigerant gas is introduced into the first compression chamber 13D and the second compression chamber 14D, the compression stroke in which refrigerant gas is compressed in the first compression chamber 13D and the second compression chamber 14D and the discharge stroke in which compressed refrigerant gas is discharged to the first discharge chamber 19A and the second discharge chamber 19B are repeated.

The refrigerant gas discharged to the first discharge chamber 19A is flowed to the discharge port 28 through the first discharge communication passage 20, and the refrigerant gas discharged to the second discharge chamber 19B is flowed to the discharge port 28 through the second discharge communication passage 23. The refrigerant gas is then introduced through the discharge port 28 into the muffler chamber 57.

Figure 2:
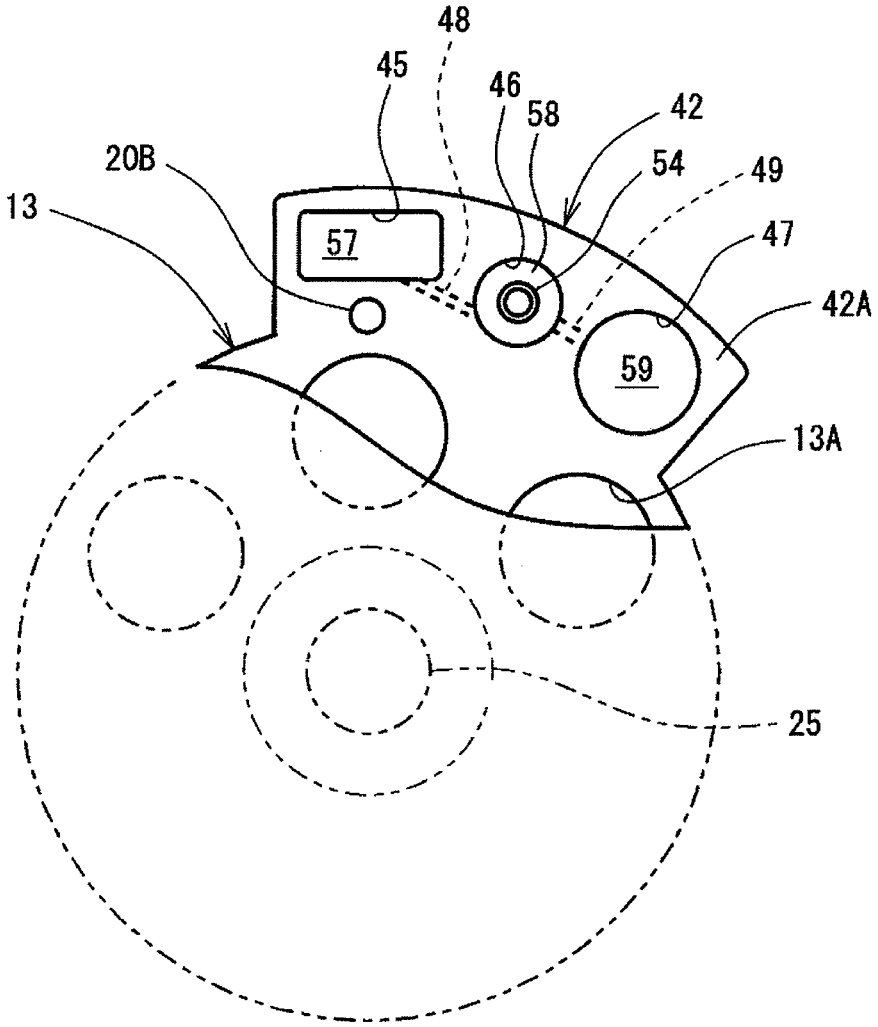
FIG. 2 is a cross-section view of the swash plate type variable displacement compressor taken along line A-A of FIG. 1.
Figure 4:
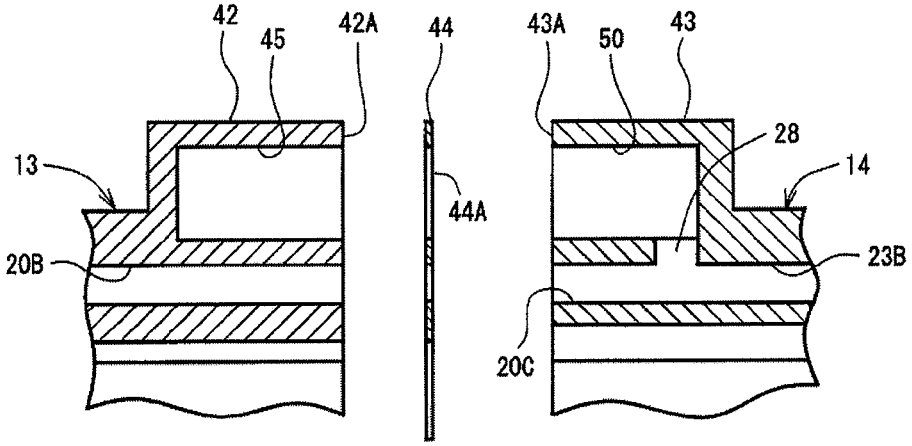
FIG. 4 is a fragmentary disassembled cross-sectional view of the swash plate type variable displacement compressor of FIG. 1, illustrating the connection of cylinder blocks of the compressor.
Figure 5:
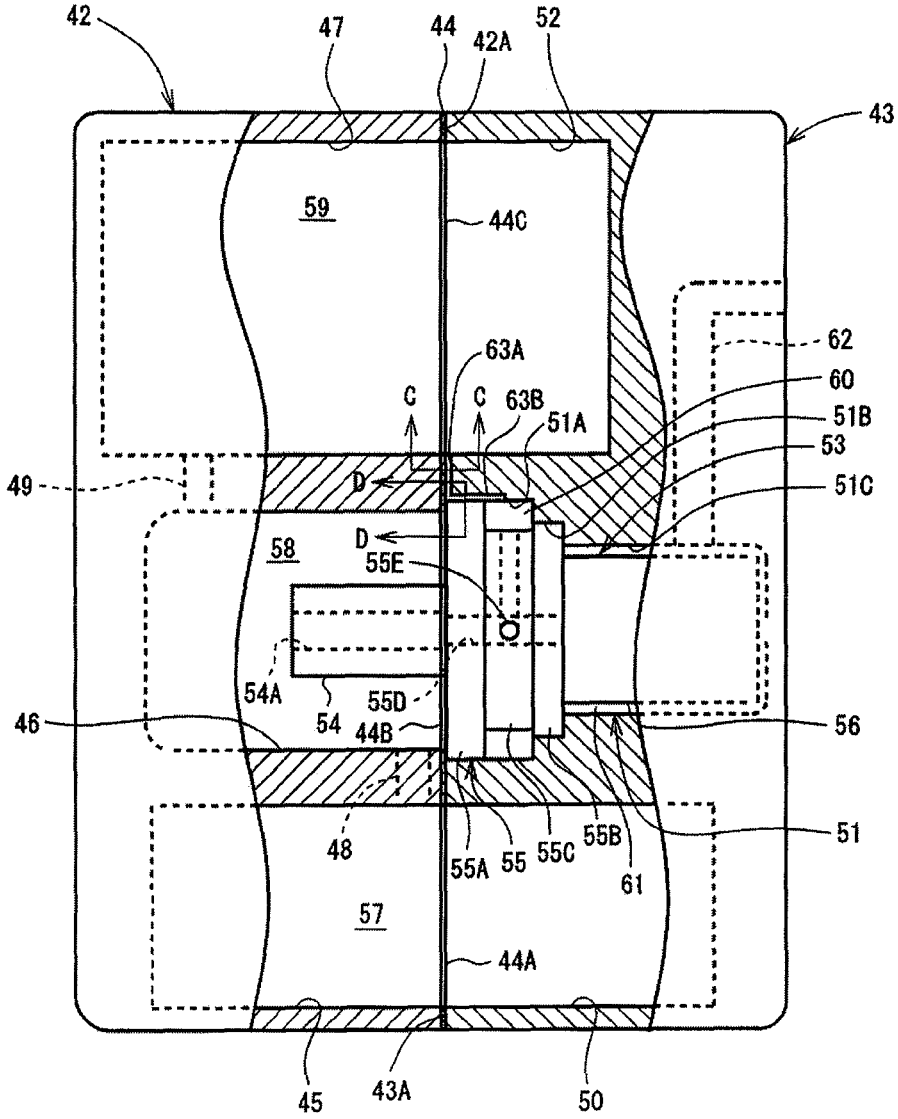
FIG. 5 is a top view of a projection of the swash plate type variable displacement compressor of FIG. 1 with the top portion of the compressor partially broken away to describe the inside structure of the projection.

As shown in FIGS. 1 and 4, the rear end surface 42A of the first projection 42 is connected to the front end surface 43A of the second projection 43 with a gasket 44 interposed therebetween. As shown in FIGS. 2 and 5, the first projection 42 has therein three first cylinder block recesses 45, 46, 47 which extends in axial direction and are opened at the rear end surface 42A. The first cylinder block recesses 45, 46, 47 are formed in this order in the first projection 42 in the circumference direction at predetermined spaced intervals. The first cylinder block recess 45 is formed radially outward of the second front communication passage 20B and has a shape of a bottomed rectangular hole. The first cylinder block recess 46 has a shape of a bottomed circular hole and an oil separator 54 of a check valve unit 53, which will be described later, is disposed in the first cylinder block recess 46. The first cylinder block recess 47 also has a shape of a bottomed circular hole. A hole 48 is formed in the first projection 42 for communication between the first cylinder block recess 45 and the first cylinder block recess 46. Additionally, a hole 49 is formed in the first projection 42 for communication between the first cylinder block recess 46 and the first cylinder block recess 47. As will be described later, the hole 48 corresponds to a gas introduction passage that provides communication between the muffler chamber 57 and the oil separation chamber 58, and the hole 49 corresponds to an oil passage that provides communication between the oil separation chamber 58 and an oil reserve chamber 59, respectively.

Figure 3:
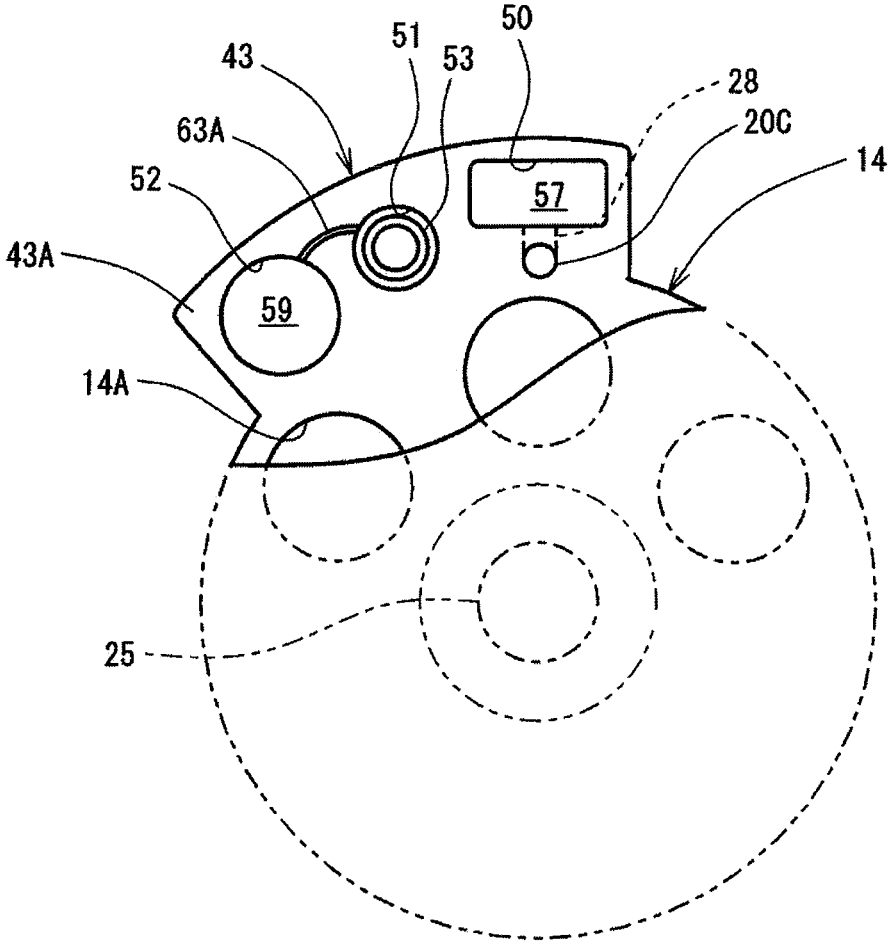
FIG. 3 is a cross-section view of the swash plate type variable displacement compressor taken along line B-B of FIG. 1.

As shown in FIGS. 3 and 5, the second projection 43 has therein three second cylinder block recesses 50, 51, 52 which extend in axial direction and are opened at the front end surface 43A of the second projection 43. The second cylinder block recesses 50, 51, 52 are formed in this order in the second projection 43 at predetermined spaced intervals in the circumferential direction. The second cylinder block recess 50 has a shape of a bottomed rectangular hole and is formed radially outward of the third rear communication passage 20C. The second cylinder block recess 50 is in communication with the third rear communication passage 20C through the discharge port 28. The second cylinder block recess 51 has a shape of a bottomed circular hole with a stepped configuration. The check valve unit 53 is mounted in the second cylinder block recess 51. The second cylinder block recess 52 is formed in a bottomed circular hole. An end surface groove 63A is formed in the front end surface 43A of the second projection 43 which connects the first and the second cylinder block recesses 51 and 52.

As shown in FIG. 4, the gasket 44 is interposed between the first projection 42 and the second projection 43. As shown in FIG. 5, with the first projection 42 and the second projection 43 combined together, the first cylinder block recess 45 and the second cylinder block recess 50 are disposed to face each other and in communication with each other. In addition, with the first and the second projections 42, 43 combined together, the first cylinder block recess 46 is in communication with the second cylinder block recess 51, and the first cylinder block recess 47 is in communication with the second cylinder block recess 52, respectively. Therefore, three chambers are formed in the first projection 42 and the second projection 43. Holes 44A, 44B, 44C are formed through the gasket 44 at the positions that correspond to the first cylinder block recess 45, 46, 47, respectively. The first cylinder block recess 45 and the second cylinder block recess 50 communicate with each other through the hole 44A thereby to form the muffler chamber 57. The muffler chamber 57 reduces pulsation of the refrigerant gas being discharged from the first discharge chamber 19A and the second discharge chamber 19B. The first cylinder block recess 47 and the second cylinder block recess 51 communicate with each other through the hole 44B and form the oil reserve chamber 59. The oil reserve chamber 59 stores the oil separated from the refrigerant gas in the oil separation chamber 58.

As shown in FIG. 5, the second cylinder block recess 51 has an inner peripheral wall 51A having a large inner diameter and is opened at the front end surface 43A of the second projection 43, an inner peripheral wall 51B having a diameter that is smaller than that of the inner peripheral wall 51A and adjoining the inner peripheral wall 51A and an inner peripheral wall 51C having a diameter that is smaller than that of the inner peripheral wall 51B and adjoining the inner peripheral wall 51B. The second cylinder block recess 51 is of a stepped configuration having two steps so that one step is formed between the inner peripheral wall 51A and the inner peripheral wall 51B and the other step between the inner peripheral wall 51B and the inner peripheral wall 51C, respectively.

The check valve unit 53 includes a cylindrical oil separator 54 that separates oil contained in the refrigerant gas therefrom, a base 55 that supports the oil separator 54 and has a larger diameter than the oil separator 54 and a check valve 56 that is mounted on the base 55. The oil separator 54, the base 55, and the check valve are integrated. A communication passage 54A is formed extending axially through the oil separator 54. The base 55 includes a flange 55A formed adjacent to the oil separator 54 and having a large diameter, a flange 55B formed adjacent to the check valve 56 and having a small diameter and a body 55C located between the flange 55A and the flange 55B. A communication passage 55D is formed extending axially through the base 55. The inner diameter of the communication passage 55D is smaller than the inner diameter of the communication passage 54A. The communication passage 54A and the communication passage 55D are connected and cooperate to form a part of a discharge passage of the refrigerant gas. A plurality of holes 55E is formed radially in the body 55C of the base 55 in communication with the communication passage 55D. The check valve 56 includes a cylindrical main body, a valve element slidably provided in the main body and an urging means for the valve element. The check valve 56 is arranged downstream of the oil separator 54 for preventing the backflow of the discharged refrigerant gas in the discharge passage.

As shown in FIG. 5, the check valve unit 53 is fitted in the second cylinder block recess 51 with the check valve 56 positioned on the rear side and the oil separator 54 on the front side, respectively, and with the flanges 55B, 55A of the base 55 in contact with the inner peripheral walls 51B, 51A, respectively. The oil separator 54 is disposed so as to project into the first cylinder block recess 46 through the hole 44B of the gasket 44, and the aforementioned oil separation chamber 58 is defined by the first cylinder block recess 46 and the front end surface of the flange 55A. An intermediate pressure chamber 60 of an annular shape is defined by the rear end of the flange 55A, the front end of the flange 55B, the outer peripheral surface of the body 55C and the inner peripheral wall 51A of the second cylinder block recess 51. The intermediate pressure chamber is formed between the oil separator 54 and the check valve 56. The intermediate pressure chamber 60 is in communication with the communication passage 55D via the holes 55E. The pressure in the intermediate pressure chamber 60 is lower than the pressure of the refrigerant gas in the oil separation chamber 58. A check valve chamber 61 is defined by the rear end surface of the flange 55B, the inner peripheral wall 51C and the bottom surface of the second cylinder block recess 51. The check valve 56 is disposed in the check valve chamber 61 and the check valve chamber 61 is connected to the external refrigerant circuit through a discharge passage 62.

As shown in FIG. 5, the second cylinder block recess 51 and the second cylinder block recess 52 are connected with each other through a passage that includes the end surface groove 63A that is formed in circumferential direction of the front end surface 43A of the second projection 43 and an inner peripheral wall groove 63B that is formed in the inner peripheral wall 51A of the second cylinder block recess 51 parallel to the axis direction in communication with the end surface groove 63A.

Figure 6A:
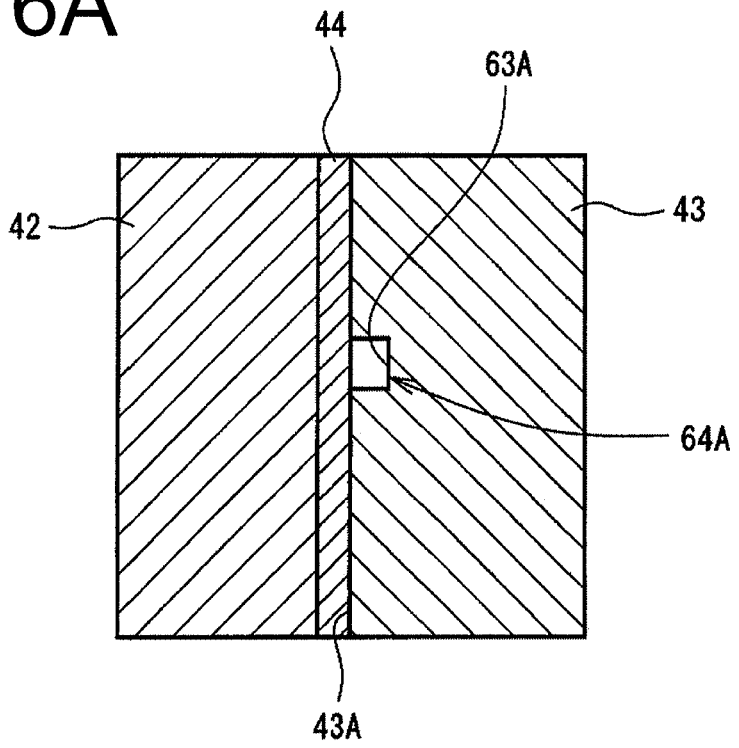
FIGS. 6A and 6B are cross-section views of the projection taken along C-C line and D-D line of FIG. 5, respectively.
Figure 6B:
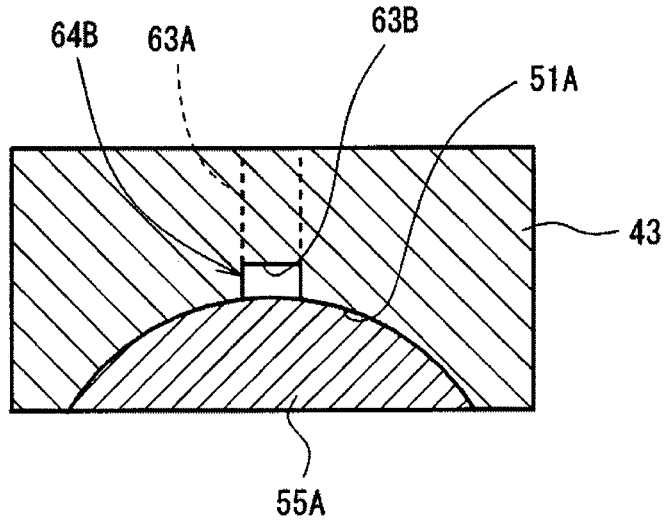

As shown in FIG. 6A, the end surface groove 63A has a rectangular cross-section and is opened through the front end surface 43A. The end surface groove 63A may have a triangular or an arc shape cross section. A gas release passage 64A is formed by covering the opening of the end surface groove 63A with the gasket 44. The gas release passage 64A is formed between the second projection 43 and the gasket 44 and serves as a communication passage between the oil reserve chamber 59 and the intermediate pressure chamber 60. As shown in FIG. 6B, the inner peripheral wall groove 63B has a rectangular cross section and is opened through the inner peripheral wall 51A. The inner peripheral wall groove 63B may have a triangular or an arc shape. A gas release passage 64B is formed by covering the opening of the inner peripheral wall groove 63B with the outer periphery surface of the flange 55A. The dimension of the inner peripheral wall groove 63B as measured in the axial direction is large enough for the inner peripheral wall groove 63B to be in communication with the intermediate pressure chamber 60. The gas release passages 64A, 64B cooperate to form a gas release passage that provides communication between the oil reserve chamber 59 and the intermediate pressure chamber 60.

The operation of the compressor 10 according to the above-described embodiment will be described. The refrigerant gas of a high pressure discharged through the discharge port 29 into the muffler chamber 57 in which the pulsation of the refrigerant gas is reduced and the refrigerant gas is then flowed into the oil separation chamber 58 through the hole 48. In the oil separation chamber 58, the discharged refrigerant gas is flowed from the base portion of the oil separator 54 toward the end of the oil separator 54 while swirling in the space between the inner wall surface of the first cylinder block recess 46 and the outer surface of the oil separator 54, and the oil contained in the refrigerant gas is separated therefrom by virtue of the centrifugal force. The refrigerant gas thus having the oil removed therefrom is introduced into the check valve chamber 61 through the communication passage 54A in the oil separator 54 and the communication passage 55D in the base 55 and then discharged into the external refrigeration circuit via the discharge passage 62.

The refrigeration gas flowing through the communication passage 54A, 55D will have a pressure loss because the inner diameter of the communication passage 55D is smaller than that of the communication passage 54A, so that the pressure of the refrigerant gas in the communication passage 55D becomes lower than that of the communication passage 54A. Therefore, the pressure P1 of the refrigerant gas in the oil separation chamber 58 is greater than the pressure P3 of the refrigerant gas in the intermediate pressure chamber 60 which is in communication with the communication passage 55D via the holes 55E.

The oil separated from the discharged refrigerant gas is temporarily stored in the oil separation chamber 58 and then flowed into the oil reserve chamber 59 through the hole 49. The pressure P2 of the refrigerant gas in the oil reserve chamber 59 is substantially the same as the pressure P3 because the oil reserve chamber 59 is in communication with the intermediate pressure chamber 60 via the gas release passages 64A, 64B. Consequently, the oil separated from the refrigerant gas is sent immediately to the oil reserve chamber 59 under the influence of the differential pressure $\Delta P$ ($\Delta P = P1 - P2$) between the oil separation chamber 58 and the oil reserve chamber 59. The refrigerant gas passing through the gas release passages 64A, 64B and accumulated in the oil reserve chamber 59 is drawn into the intermediate pressure chamber 60 and is discharged through the hole 55E to the communication passage 55D which is a part of the discharge path.

In the swash plate type variable displacement compressor 10, the displacement is variable depending on the inclination angle of the swash plate 33. When the inclination angle of the swash plate 33 is small, the displacement of the compressor 10 is reduced and, therefore, the flow rate of refrigerant gas flowing through the discharge port 28 to be introduced to the oil separation chamber 58 is reduced. In such a case, it becomes difficult for the oil that is separated in the oil separation chamber 58 to flow into the oil reserve chamber 59. However, because the differential pressure $\Delta P$ is generated between the oil separation chamber 58 and the oil reserve chamber 59 by the formation of the gas release passages 64A, 64B, the oil separated in the oil separation chamber 58 can be transferred at a low flow rate to the oil reserve chamber 59.

The gas release passage providing the communication between the oil reserve chamber 59 and the intermediate pressure chamber 60 is formed by the gas release passages 64A, 64B. The gas release passage 64A is formed by the gasket 44 and the end surface groove 63A that is formed in the front end surface 43A of the second projection 43 and connects the second cylinder block recesses 51 and 52. The gas release passage 64B is formed by the outer peripheral surface of the flange 55A and the inner peripheral wall groove 63B that is formed in the inner peripheral wall 51A of the second cylinder block recess 51 and connected to the end surface groove 63A. Compared with the conventional compressor which requires machining a hole to form the gas release passage, the gas release passage is easily formed in the compressor 10 because it only requires forming grooves in the surface of the second projection 43 and the inner wall of the second cylinder block recess 51. In addition, the shape and the size of the groove can be selected freely.

The gasket 44 interposed between the first cylinder block 13 and the second cylinder block 14 serving as a sealing also serves as a component for forming a part of the gas release passage 64A.

The check valve unit 53 includes the oil separator 54, the base 55 and the check valve 56 that are integrated, and the check valve unit 53 is fitted in the second cylinder block recess 51. Thus, the mounting of the check valve unit 53 may be accomplished easily and the number of parts for the compressor 10 may be reduced.

The oil separation chamber 58 formed around the oil separator 54, the intermediate pressure chamber 60 formed between the flange 55A, 55B and the check valve chamber 61 formed around the check valve 56 are shut off from communication with each other by the flanges 55A, 55B formed as a part of the base 55 of the check valve unit 53 and fitted in contact with the inner peripheral wall 51A, 51B of the second cylinder block recess 51.

The first cylinder block 13 and the second cylinder block 14 have on outer peripheral sides thereof the first projection 42 and the second projection 43 projecting radially, respectively, and the muffler chamber 57, the oil separation chamber 58 and the oil reserve chamber 59 are formed in the first cylinder block recesses 45, 46, 47 and the second cylinder block recess 50, 51, 52 formed in the first projection 42 and the second projection 43, respectively. Compared with the conventional compressor in which the oil separation chamber and the oil reserve chamber are formed in the rear housing, the compressor 10 has a simpler structure.

The compressor 10 of the present embodiment offers following effects.

(1) The gas release passage, which provides a communication between the oil reserve chamber 59 and the intermediate pressure chamber 60, is formed by the gas release passages 64A, 64B. The gas release passage 64A is formed by the gasket 44 and the end surface groove 63A that is formed in the front end surface 43A of the second projection 43 and connects the second cylinder block recesses 51 and 52. The gas release passage 64B is formed by the outer peripheral surface of the flange 55A and the inner peripheral wall groove 63B that is formed in the inner peripheral wall 51A of the second cylinder block recess 51 and connected to the end surface groove 63A. The refrigerant gas accumulated in the oil reserve chamber 59 may be released through the gas release passages 64A, 64B. The gas release passage that provides fluid communication the oil reserve chamber 59 with the intermediate pressure chamber 60 can be formed easily merely by forming grooves in the end surface of the second projection 43 and the inner peripheral wall of the second cylinder block recess 51. The shape and the size of the grooves can be selected freely.

(2) The gasket 44 interposed between the first cylinder block 13 and the second cylinder block 14 serving as a sealing serves also as a component forming a part of the gas release passage 64A, thus reducing the number of parts of the compressor 10.

(3) The check valve unit 53 is mounted easily because the oil separator 54, the base 55 and the check valve 56 are integrated to form the check valve unit 53 and the mounting only requires fitting the check valve unit 53 in the second cylinder block recess 51 having a stepped structure. Manufacturing cost can be reduced compared with the case when the oil separator 54 and the check valve 56 are separately mounted.

(4) The oil separation chamber 58 formed around the oil separator 54, the intermediate pressure chamber 60 formed between the flange 55A, 55B and the check valve chamber 61 formed around the check valve 56 are shut off from communication with each other by the flanges 55A, 55B formed as a part of the base 55 of the check valve unit 53 and fitted in contact with the inner peripheral walls 51A, 51B of the second cylinder block recess 51. The intermediate pressure chamber 60 can be formed easily between the oil separation chamber 58 and the check valve chamber 61 merely by fitting the check valve unit in the second cylinder block recess 51 having a stepped structure.

(5) The first projection 42 and the second projection 43 are formed projecting radially from the outer circumference of the first cylinder block 13 and the second cylinder block 14, respectively, and the muffler chamber 57, the oil separation chamber 58 and the oil reserve chamber 59 are formed adjacent to each other in the first cylinder block recesses 45, 46, 47 and the second cylinder block recess 50, 51, 52 in the projection 42, 43, respectively. Compared with the case of the conventional compressor in which the oil separation chamber and the oil reserve chamber are formed in the rear housing, the communication passage can be formed easily and, therefore, the compressor 10 can be made simple in structure.

The present invention is not limited to the above described embodiment, but it may be modified in various manners within the scope of the invention, as exemplified below.

Figure 7:
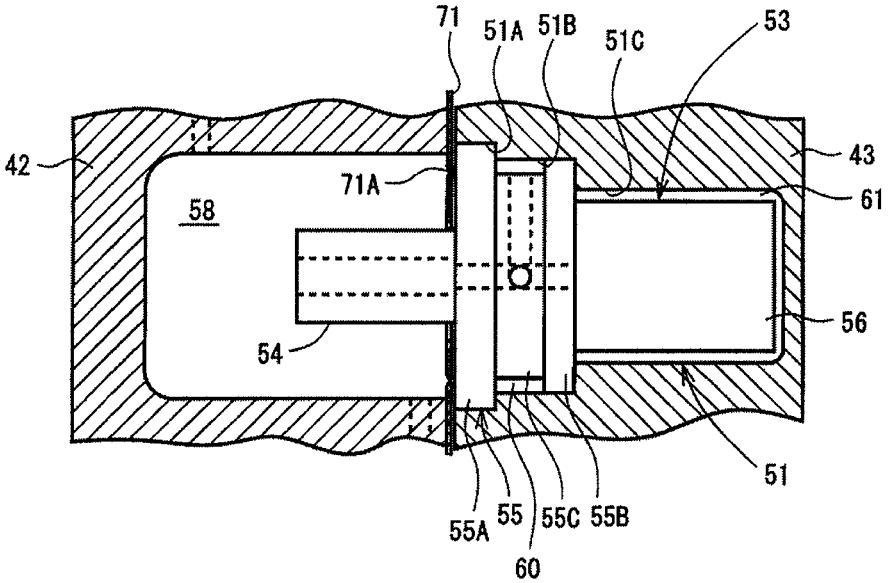
FIG. 7 is a cross-section view of a check valve unit in another embodiment according to the present invention.

As shown in FIG. 7, the check valve unit 53 may be fixed in the second cylinder block recess 51 by pressing a gasket 71 having a bead 71A against the flange 55A of the check valve unit 53. With the flange 55A, 55B pressed against the stepped portion of the second cylinder block recess 51 by the gasket 71, the oil separation chamber 58, the intermediate pressure chamber 60 and the check valve chamber 61 are sealed to be shut off from communication with each other. In this case, the gasket 71 forms a part the oil separation chamber 58. The gasket 71 may not be provided with the bead 71A.

Although, in the present invention, the end surface groove 63A is formed in the front end surface 43A of the second projection 43 so as to provide communication between the oil reserve chamber 59 and the intermediate pressure chamber 60, a groove may be formed in the rear end surface 42A of the first projection 42. In this case, the check valve unit 53 is mounted in the first cylinder block recess 46.

Although, in the present invention, the end surface groove 63A is formed in the front end surface 43A of the second projection 43 so as to provide fluid communication between the oil reserve chamber 59 and the intermediate pressure chamber 60, a groove or a recess may be formed in the gasket instead of the end surface.

Although the muffler chamber 57 is formed adjacent to the oil separation chamber in the above-described embodiment, the muffler chamber 57 may be dispensed with and it may be so configured that the discharge port 28 is directly connected to the hole 48.

What is claimed is:

1. A swash plate type variable displacement compressor comprising:

a housing having a suction chamber, a discharge chamber, a swash plate chamber in communication with the suction chamber, a first cylinder block and a second cylinder block, the first cylinder block having a plurality of first cylinder bores, the second cylinder block having a plurality of second cylinder bores that cooperate with the first cylinder bores to form plural pairs of the first and second cylinder bores;

a drive shaft rotatably supported in the housing;

a swash plate rotatable in the swash plate chamber by the rotation of the drive shaft;

a link mechanism provided between the drive shaft and the swash plate to change an inclination angle of the swash plate relative to a plane extending perpendicularly to an axis of the drive shaft;

a plurality of double head pistons reciprocally movable in the respective pairs of the first and second cylinder bores;

a conversion mechanism converting the rotation of the swash plate to the reciprocal motion of the double head pistons with a stroke length that is variable according to the inclination angle of the swash plate;

an actuator disposed in the swash plate chamber to change the inclination angle of the swash plate; and a control mechanism controlling the actuator;

wherein the actuator includes a partitioning member provided on the drive shaft, a moving member that is connected to the swash plate and movable in an axial direction of the drive shaft in the swash plate chamber and a pressure control chamber that is defined by the partitioning member, the moving member and the drive shaft, the moving member being movable by pressure in the pressure control chamber;

wherein the first cylinder block and the second cylinder block have on outer peripheral side thereof a first projection and a second projection projecting radially, respectively;

wherein the first projection and the second projection cooperate together to form at least two chambers in one of which a check valve unit including an oil separator and a check valve is disposed, the one chamber having an oil separation chamber in which the oil separator is disposed to separate oil contained in refrigerant gas being discharged from the discharge chamber, the check valve being disposed downstream of the oil separator, the other of the chamber that is in communication with the oil separation chamber and reserves the oil being separated from the refrigerant gas in the oil separation chamber;

wherein an intermediate pressure chamber is formed between the oil separator and the check valve and has pressure lower than the oil separation chamber;

wherein the first cylinder block and the second cylinder block are joined via a gasket, wherein a gas release passage is formed between the first projection or the second projection and the gasket to provide fluid communication between the oil reserve chamber and the intermediate pressure chamber.

2. The swash plate type variable displacement compressor according to claim 1, wherein the check valve unit has a flange that supports the oil separator and is fixed in the first projection or the second projection by pressing the gasket against the flange, wherein the gasket forms a part of the oil separation chamber.

3. The swash plate type variable displacement compressor according to claim 1, wherein the first projection and the second projection cooperate together to further form a muffler chamber that reduces pulsation of the refrigerant gas being discharged from the discharge chamber, wherein the muffler chamber is formed adjacent to the oil separation chamber and in communication with the oil separation chamber and the discharge chamber.

* * * * *